US010111475B2

(12) United States Patent
Butler

(10) Patent No.: US 10,111,475 B2
(45) Date of Patent: Oct. 30, 2018

(54) SWIMWEAR APPARATUS

(71) Applicant: Mylitta Butler, Tampa, FL (US)

(72) Inventor: Mylitta Butler, Tampa, FL (US)

( * ) Notice: Subject to any disclaimer, the term of this patent is extended or adjusted under 35 U.S.C. 154(b) by 28 days.

(21) Appl. No.: 15/623,620

(22) Filed: Jun. 15, 2017

(65) Prior Publication Data

US 2017/0295859 A1 Oct. 19, 2017

Related U.S. Application Data

(63) Continuation-in-part of application No. 15/160,189, filed on May 20, 2016, now Pat. No. 9,706,799.

(60) Provisional application No. 62/321,789, filed on Apr. 13, 2016.

(51) Int. Cl.
*A41D 7/00* (2006.01)
*A41D 31/00* (2006.01)

(52) U.S. Cl.
CPC ..... *A41D 7/00* (2013.01); *A41D 31/0061* (2013.01); *A41D 2400/28* (2013.01)

(58) Field of Classification Search
CPC ..... A41D 7/00; A41D 7/005; A41D 31/02
See application file for complete search history.

(56) References Cited

U.S. PATENT DOCUMENTS 4,449,254 A 5/1984 Fogg

*Primary Examiner* — Shaun R Hurley
*Assistant Examiner* — Andrew W Sutton
(74) *Attorney, Agent, or Firm* — Burr & Forman LLP; Ryan M. Corbett

(57) ABSTRACT

A swimwear apparatus is provided. The swimwear apparatus may include an upper portion having an upper base layer and an upper bikini layer, and a lower portion having a lower base layer and a lower bikini layer. The upper bikini layer may be configured to be removably attached to the upper base layer, and the lower bikini layer may be configured to be removably attached to the lower base layer.

20 Claims, 15 Drawing Sheets

SWIMWEAR APPARATUS

CROSS-REFERENCE TO RELATED APPLICATION

This application claims the benefit of U.S. Non-Provisional patent application Ser. No. 15/160,189, filed on May 20, 2016, which claims the benefit of U.S. Provisional Patent Application No. 62/321,789, filed on Apr. 13, 2016, both of which are incorporated herein by reference in its entirety.

TECHNICAL FIELD

The present disclosure generally relates to a women's swimwear apparatus, and more particularly to a women's swimwear apparatus having interchangeable components that provided added comfort and support as compared with related art swimwear.

SUMMARY

Many women dread the thought of wearing conventional swimsuits, which are typically one- or two-piece swimsuits, because they tend to be more revealing than many women would prefer. Such conventional bathing suits require the wearer to reveal their bare-skinned legs as well as other less desirable areas of the body. For example, many women are uncomfortable wearing conventional swimsuits because they may have visible varicose veins, unsightly scars from surgeries, skin disorders or pregnancy marks, etc. Accordingly, there is a need for a device that will improve the appearance of certain areas of a woman's body so they can feel more comfortable appearing in public in a swimsuit.

In addition to this drawback, when wearing conventional swimsuits women often experience their inner thighs rubbing together, which causes a great deal of discomfort and pain. Thus, there is also a need for a swimwear device that mitigates the discomfort associated with the wearer's inner thighs rubbing together.

Yet another drawback of conventional swimsuits is the lack of support provided. It is a common practice among women to wear girdles or body shapers underneath their clothes to slim, shape and help contour areas of the body that need the most help. But none of these shaping products assist women when the time calls to come out of their clothes and get dressed appropriately for water activities. Recently, so-called "gym and swim" attire has become popular to address this issue, however, this attire looks like yoga/exercise attire, which leaves the undesirable impression that the wearer has just left the gym, and is not specifically dressed for water activities. Accordingly, there is a need for a device that provides the support of body shaper devices, but that is also designed for wearing while participating in water activities.

According to an aspect of one or more exemplary embodiments of the present disclosure, there is provided a swimwear apparatus that may help to reduce and or eliminate discomfort of inner thigh chaffing by providing a buffer of fabric. The swimwear apparatus may also allow women to choose comfort, support and modesty without having to compromise showing too much of their body in order to participate in water activities.

According to one or more exemplary embodiments of the present disclosure, there is provided a swimwear apparatus that may include an upper portion having an upper base layer and an upper bikini layer, and a lower portion having a lower base layer and a lower bikini layer. The upper bikini layer may be configured to be removably attached to the upper base layer, and the lower bikini layer may be configured to be removably attached to the lower base layer. The lower base layer may include at least one base legging that is configured to be attached, removably or permanently, to a bottom portion of the lower bikini layer.

The lower bikini layer may include a front lower bikini portion that is connected to a back lower bikini portion.

The lower bikini layer may also include first and second connection portions disposed on opposite sides of the front lower bikini portion that removably attach the lower bikini layer to the lower base layer.

The lower bikini layer may also include first and second connection portions disposed on a first side of the front lower bikini portion, and third and fourth connection portions disposed on a second side of the front lower bikini portion. The first, second, third, and fourth connecting portions may be configured to removably attach the lower bikini layer to the lower base layer.

The first and second connection portions may include at least one of snaps, waterproof hook and loop fasteners, buttons, and waterproof zippers that removably attach the lower bikini layer to the lower base layer.

The lower bikini layer may also include third and fourth connection portions disposed on opposite sides of the back lower bikini portion. When the first, second, third, and fourth connection portions are used to removably attach the lower bikini layer to the lower base layer, the first and second connection portions may not be in contact with the third and fourth connection portions. Alternatively, when the first, second, third, and fourth connection portions are used to removably attach the lower bikini layer to the lower base layer, the first and second connection portions may be in contact with the third and fourth connection portions, respectively.

The front lower bikini portion may also include a first gap between the first and second connection portions, and a second gap between the third and fourth connection portions. The first gap or the second gap may be rectangular or triangular shaped.

The lower bikini layer may include fifth and sixth connection portions disposed on opposite sides of the back lower bikini portion that removably attach the lower bikini layer to the lower base layer. The fifth and sixth connection portions may be disposed on a first side of the back lower bikini portion, and seventh and eighth connection portions may be disposed on a second side of the back lower bikini portion. The fifth, sixth, seventh, and eighth connection portions may be. configured to removably attach the lower bikini layer to the lower base layer.

The back lower bikini portion may include a third gap between the fifth and sixth connection portions, and a fourth gap between the seventh and eighth connection portions. The first connection portion may be removably attached to the fifth connection portion and the second connection portion may be removably attached to the sixth connection portion. The third connection portion may be removably attached to the seventh connection portion and the fourth connection portion may be removably attached to the eighth connection portion. The first gap and the third gap may form a first continuous horizontal gap through which the lower base layer is visible on a first side of the lower bikini layer. The second gap and the fourth gap may form a second continuous horizontal gap through which the lower base layer is visible on a second side of the lower bikini layer.

The lower bikini layer may include a skirt configured to wrap around at least a portion of a waist of a wearer of the swimwear apparatus.

The upper bikini layer may include a left upper bikini layer and a right upper bikini layer. The left upper bikini layer may include a first connection portion that removably attaches the left upper bikini layer to the upper base layer, and the right upper bikini layer may include a second connection portion that removably attaches the right upper bikini layer to the upper base layer. The left upper bikini portion and the right upper bikini portion may each include at least three connection portions that removably attach the upper bikini layer to the upper base layer.

The lower base layer and the upper base layer may be made of a semi-transparent material. The lower base layer and the upper base layer may be made of a compression fabric. The lower base layer and the upper base layer may be made of a material that allows ultra-violet light to pass through the fabric. The lower base layer may include an opening that, when worn by a wearer, is disposed in a crotch region of the wearer. The lower base layer and the upper base layer may be connected to form a single base layer.

According to an aspect of one more exemplary embodiments, the lower portion may include a lower base layer, a first lower bikini layer configured to be attached to a first side of the lower base layer, and a second lower bikini layer configured to be attached to a second side of the lower base layer. The upper bikini layer may include a first upper bikini layer configured to be attached to a first side of the upper base layer, and a second upper bikini layer configured to be attached to a second side of the upper base layer. At least one of the first lower bikini layer, the second lower bikini layer, the first upper bikini layer, and the second upper bikini layer may be configured to be removably attached to their respective lower base layer and upper base layer.

DETAILED DESCRIPTION OF EXEMPLARY EMBODIMENTS

Figure 1:
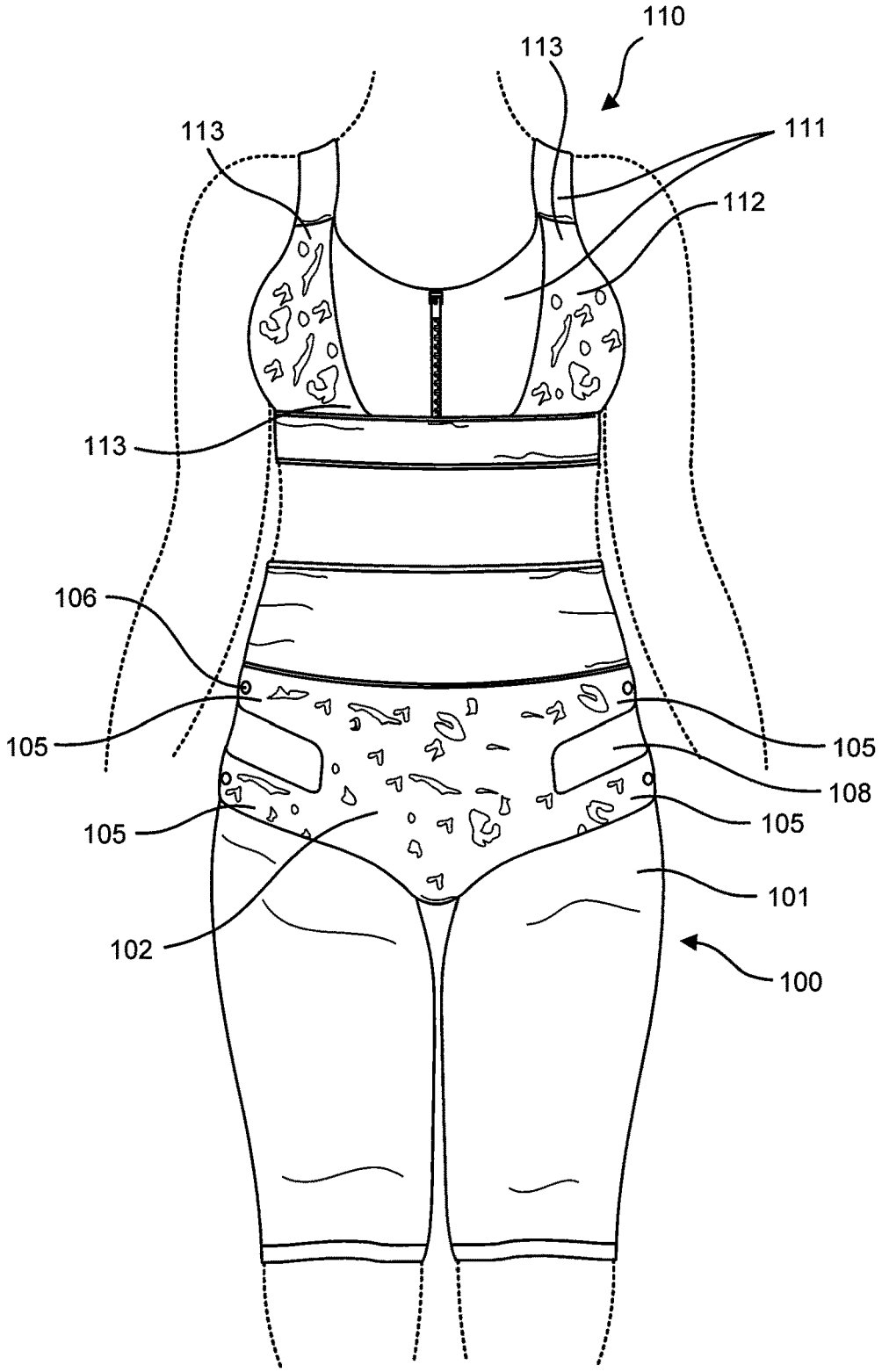
FIG. 1 is a front view of a swimwear apparatus according to an exemplary embodiment.
Figure 2:
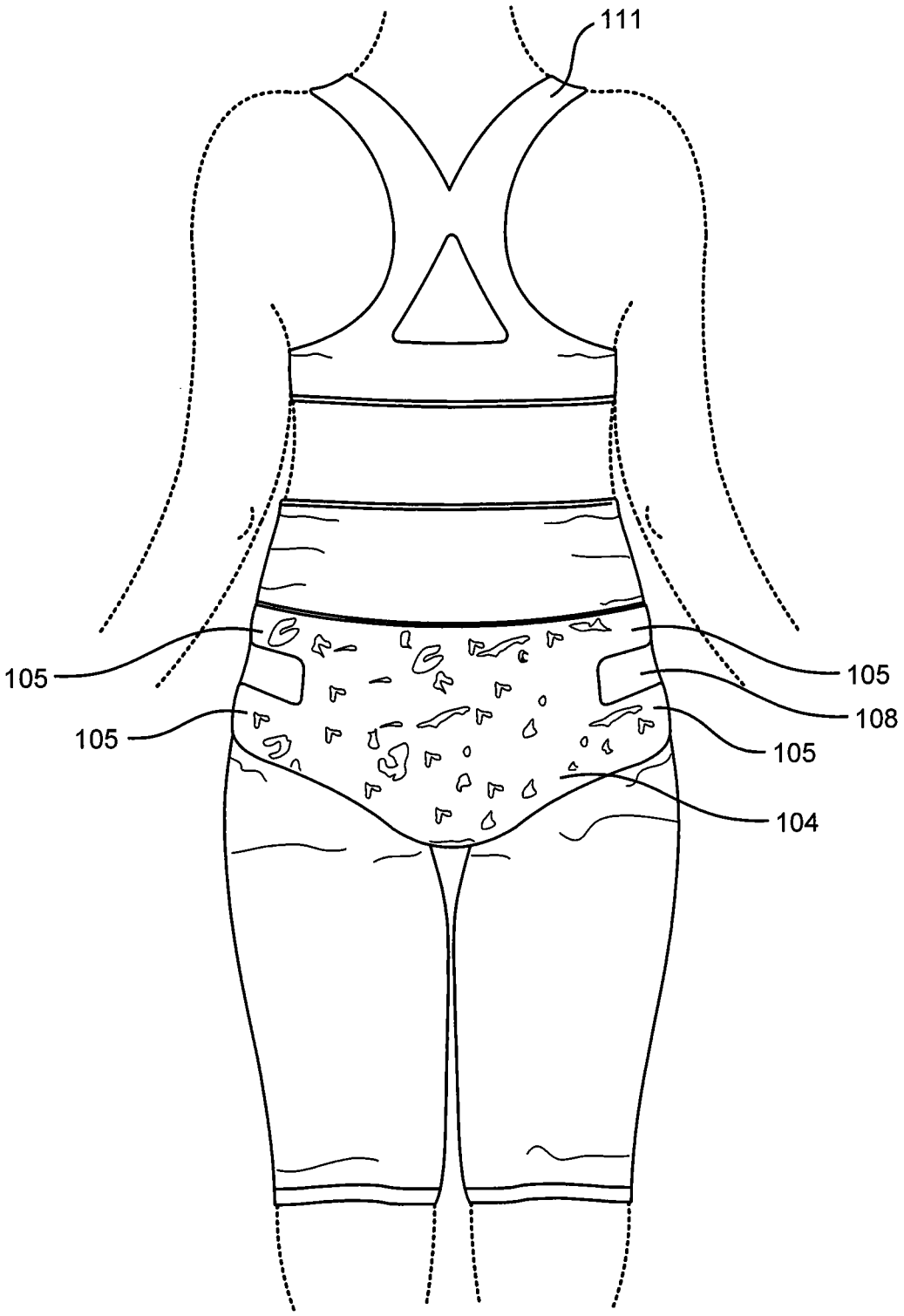
FIG. 2 is a rear view of a swimwear apparatus according to an exemplary embodiment.

Reference will now be made in detail to the following exemplary embodiments, which are illustrated in the accompanying drawings, wherein like reference numerals refer to like elements throughout. The exemplary embodiments may be embodied in various forms without being limited to the exemplary embodiments set forth herein. Descriptions of well-known parts are omitted for clarity.

Figure 3:
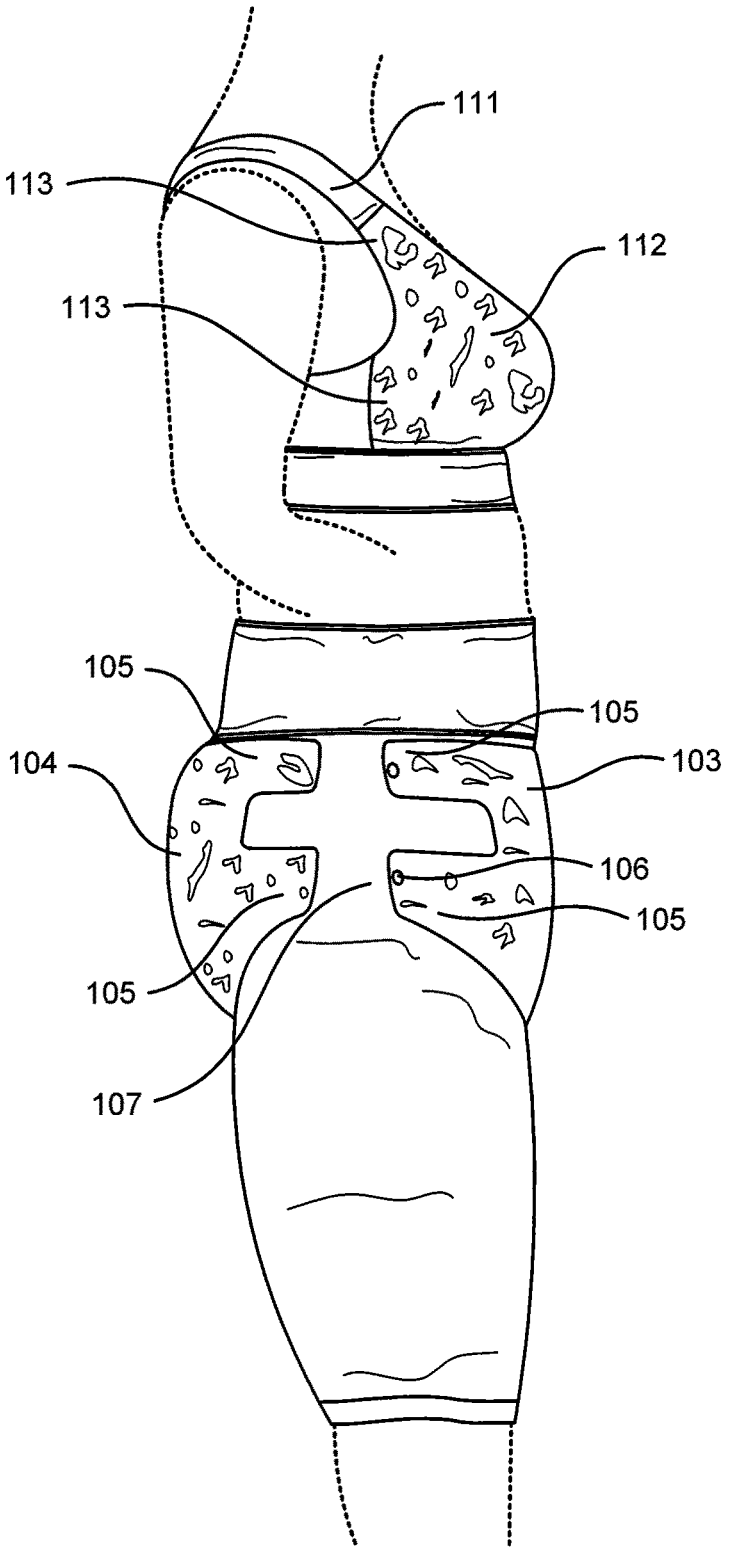
FIG. 3 is a right lateral view of a swimwear apparatus according to an exemplary embodiment.
Figure 4:
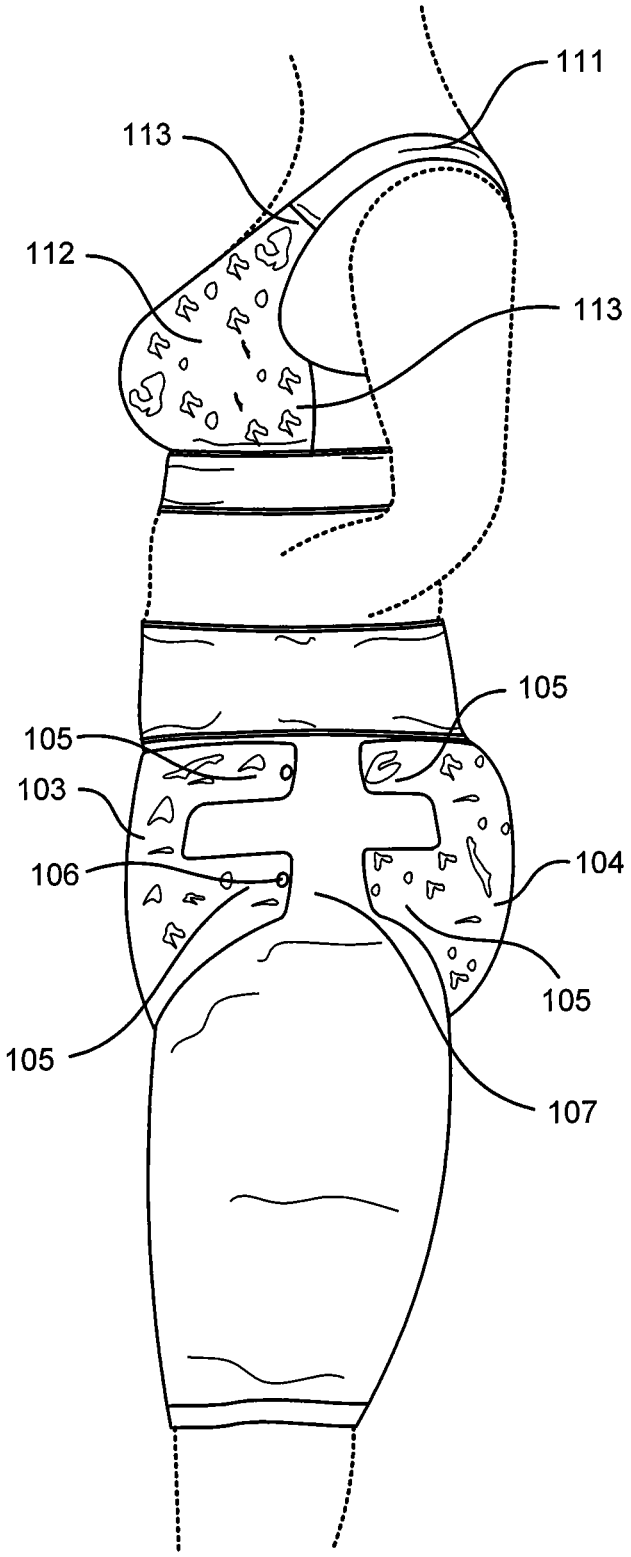
FIG. 4 is a left lateral view of a swimwear apparatus according to an exemplary embodiment.
Figure 5:
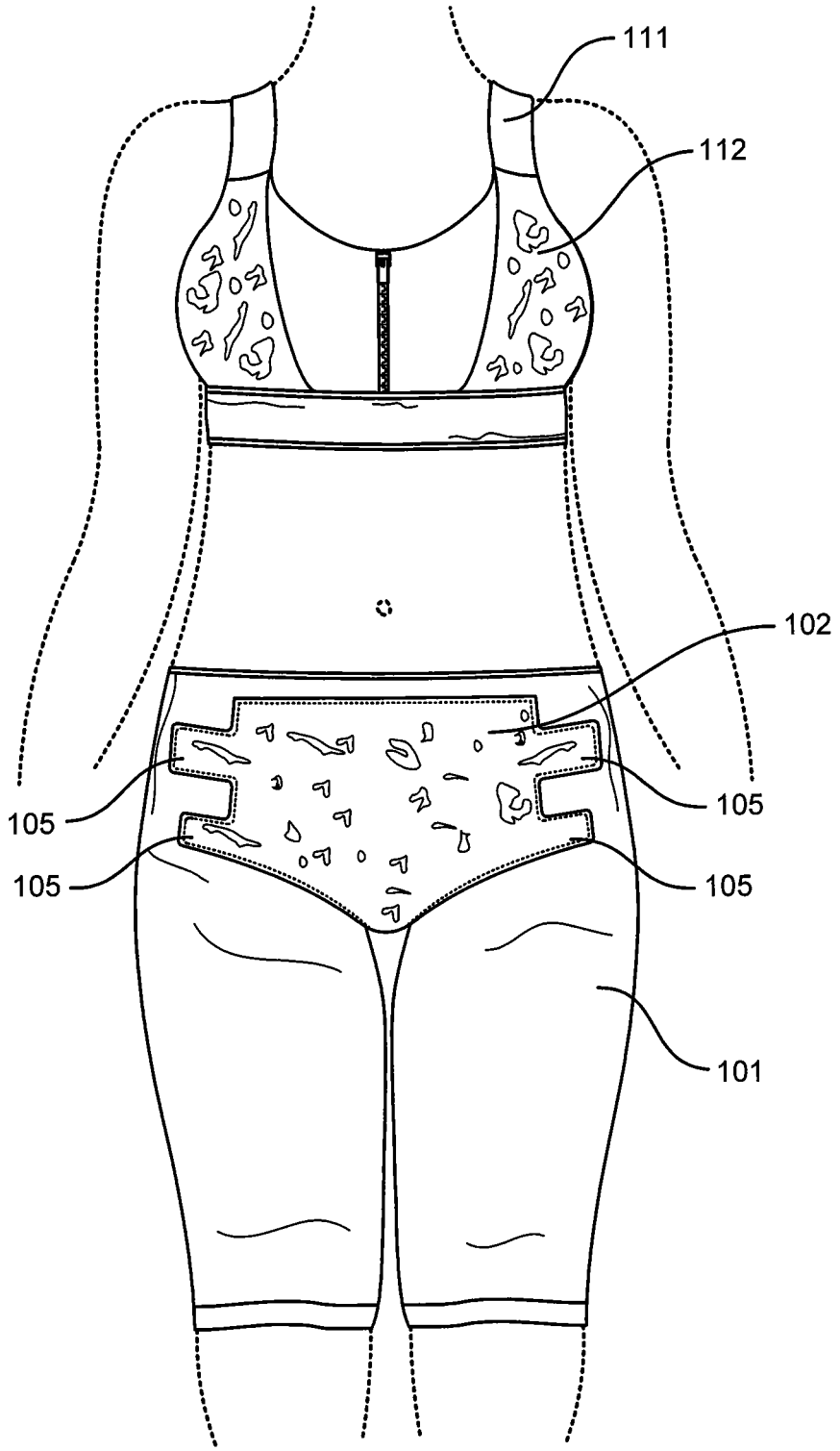
FIG. 5 is a front view of a swimwear apparatus according to another exemplary embodiment.
Figure 6:
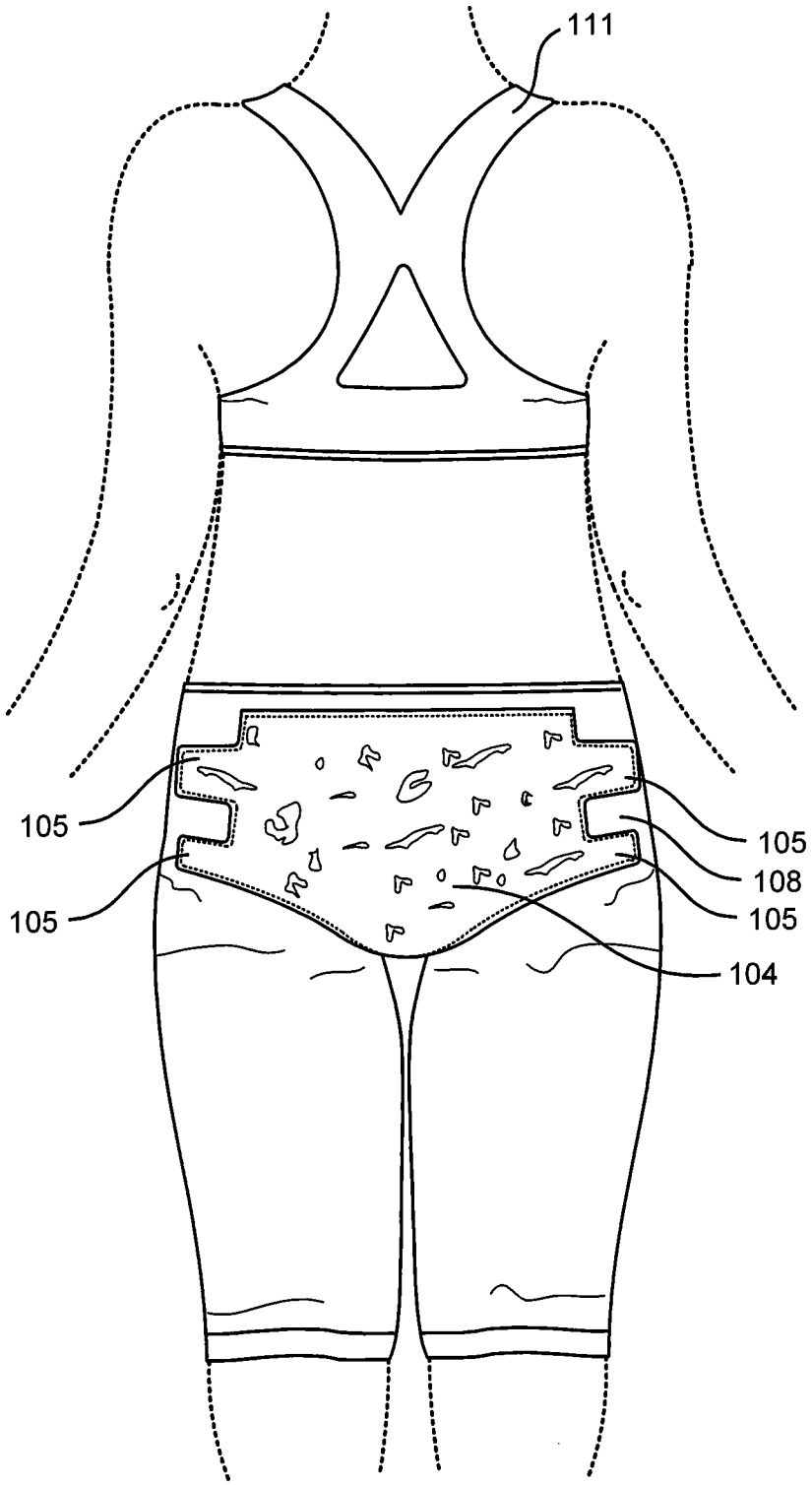
FIG. 6 is a rear view of a swimwear apparatus according to another exemplary embodiment.
Figure 7:
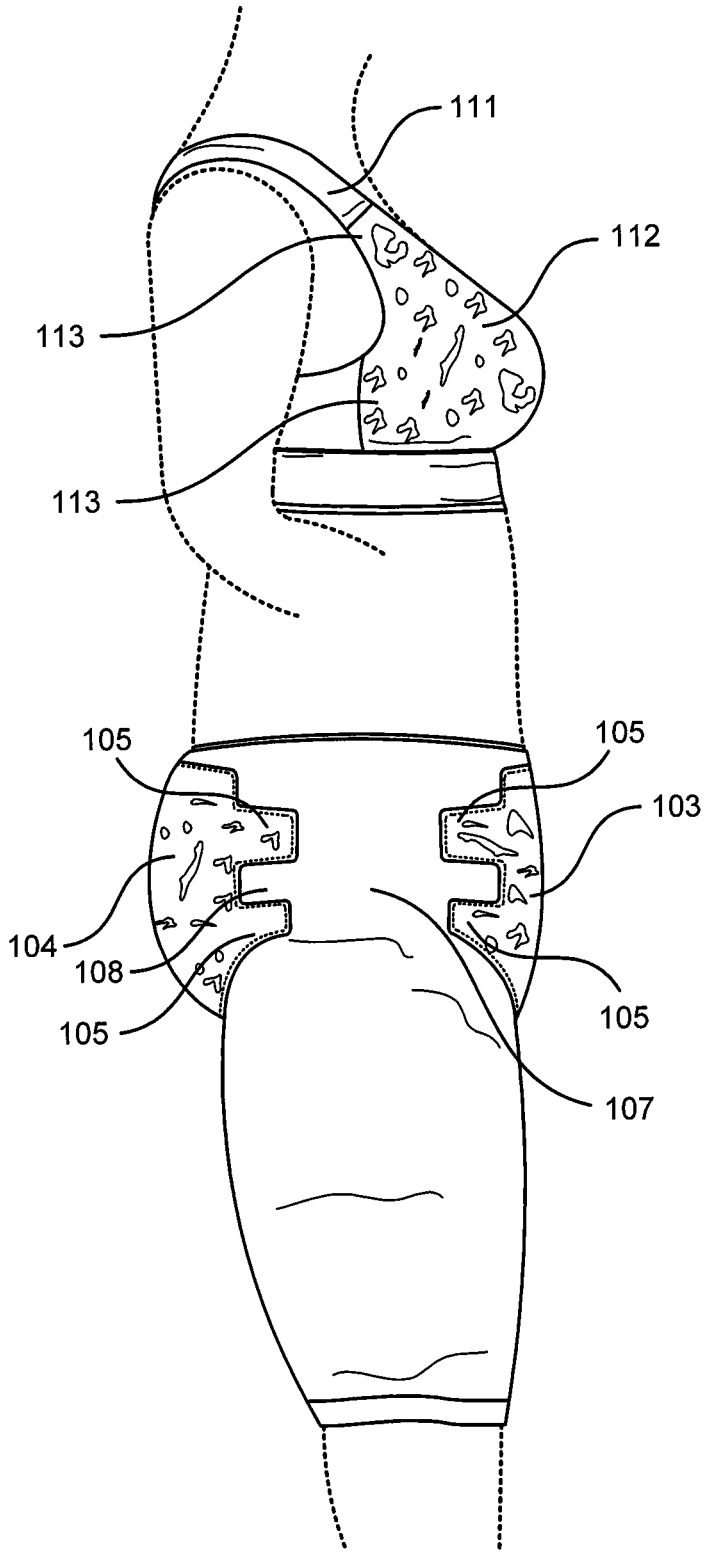
FIG. 7 is a right lateral view of a swimwear apparatus according to another exemplary embodiment.
Figure 8:
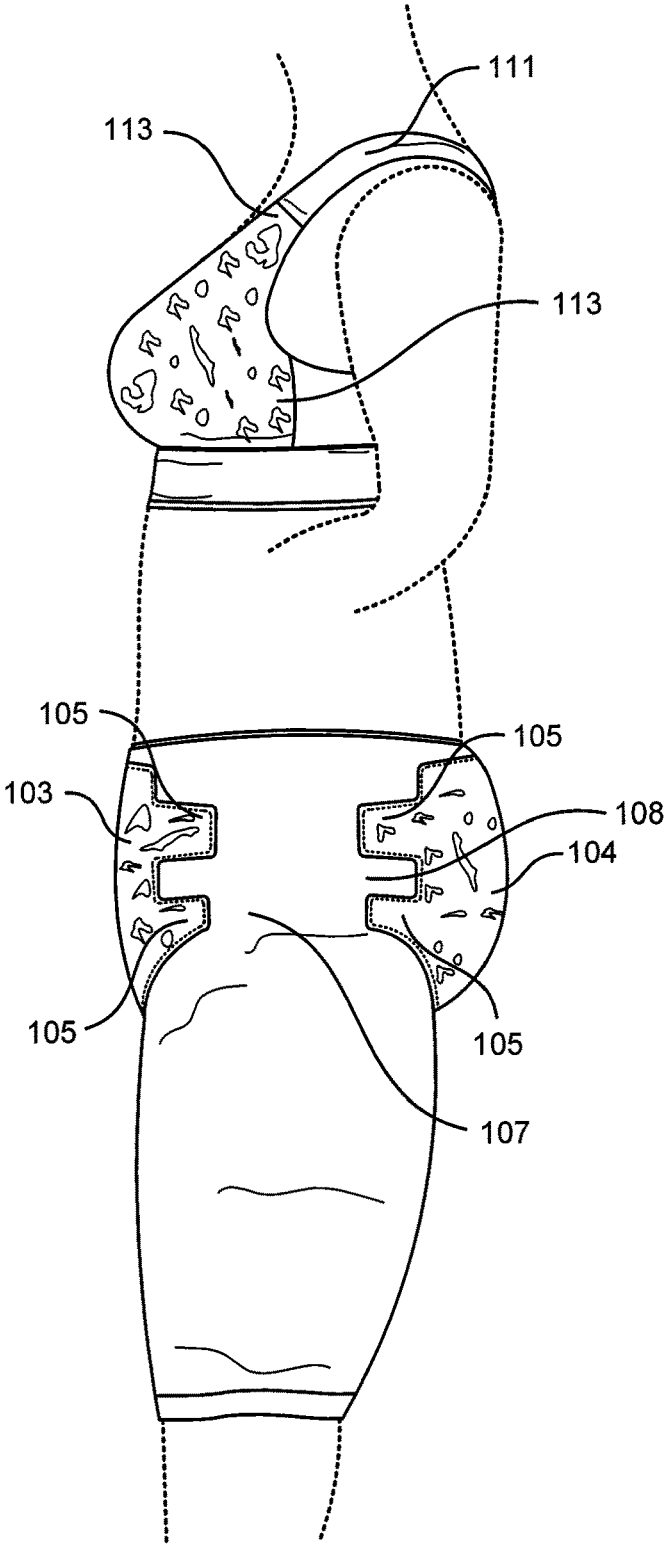
FIG. 8 is a left lateral view of a swimwear apparatus according to another exemplary embodiment.
Figure 9:
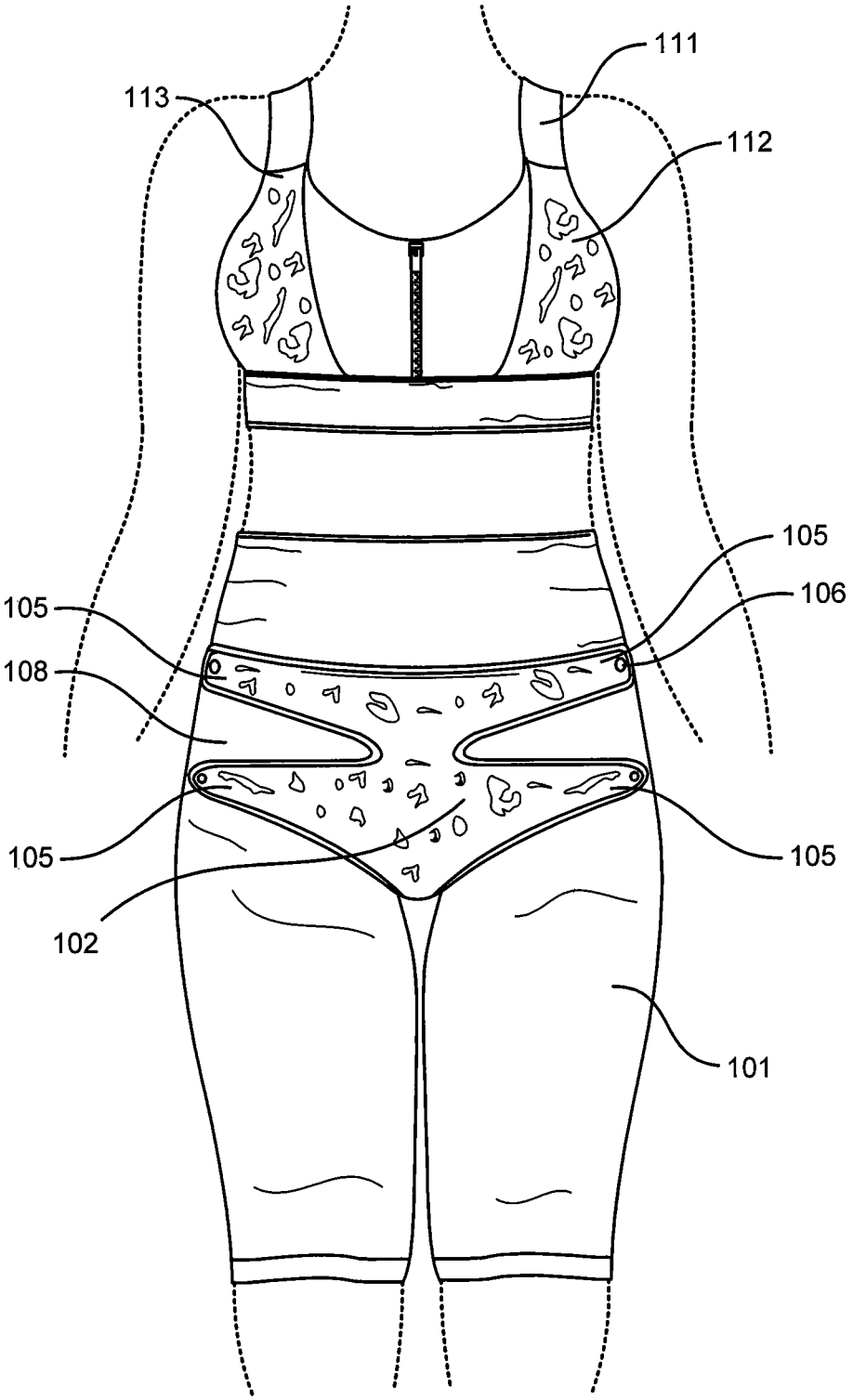
FIG. 9 is a front view of a swimwear apparatus according to yet another exemplary embodiment.

FIGS. 1 through 4 illustrate a swimwear apparatus according to an exemplary embodiment. Referring to FIGS. 1 through 4, the swimsuit apparatus of the exemplary embodiment may include a lower portion 100 and an upper portion 110. The lower portion 100 may include a lower base layer 101 and a lower bikini layer 112. The lower base layer 101 may be similar to a pair of leggings, shorts, or capri pants. The lower bikini layer 102 may be similar to a bikini bottom, and may be configured to attach, removably or permanently, to the lower base layer 101. The lower bikini layer 102 may include front and back lower bikini portions 103, 104 (as shown in FIG. 3) that are connected to each other, and that are configured to attach to the lower base layer 101 at a lateral position of the lower base layer 101. According to an exemplary embodiment, the front and back lower bikini portions 103, 104 may each include four connecting portions 105, two on each side, for connecting the lower bikini layer 102 to the lower base layer 101, however a different number of connecting portions 105 may be used. For example, the front and back lower bikini portions 103, 104 may each have two, six, or eight connecting portions 105. The connecting portions 105 may include snaps 106 for attaching the lower bikini layer 102 to the lower base layer 101 of the lower portion 100. Alternatively, the connecting portions may include waterproof hook and loop fasteners, buttons, waterproof zippers, or other mechanisms for attaching the lower bikini layer 102 to the lower base layer 101.

According to an exemplary embodiment, the connecting portions 105 of the front and back lower bikini portions 103, 104 may not connect on the side of the wearer when in use, such that there is a gap 107 between the front and back lower bikini portions 103, 104 on the side of the wearer. Alternatively, the connecting portions 105 of the front and back lower bikini portions 103, 104 may connect on the side of the wearer to create the appearance that the front and back lower bikini portions 103, 104 are connected on the side of the wearer. The lower bikini layer 102 may be configured to be removable and interchangeable, such that the wearer can wear different lower bikini layers 102 with the lower base layer 101. Alternatively, the lower bikini layer 102 may be permanently attached to the lower base layer 101.

According to the exemplary embodiment of FIGS. 1-4, the connecting portions 105 of the front lower bikini portion 103 and back lower bikini portion 104 may be separated vertically such that there are gaps 108 between the connection portions 105 on each side of the front and back lower bikini portion 103, 104. Spacing the connecting portions 105 on each side of the front lower bikini portion 103 and back lower bikini portion 104 allows for the connecting portions 105 to be independently adjustable to provide a more comfortable fit.

According to another exemplary embodiment, the lower bikini layer 102 may also be in the form of a skirt that wraps around the waist of the wearer. According to this exemplary embodiment, the skirt may also include multiple connecting portions 105 having snaps, waterproof hook and loop fasteners, buttons, waterproof zippers, or other mechanisms 106 for connecting the skirt to the base layer. According to an exemplary embodiment, the skirt may extend the entire circumference surrounding the waist of the wearer. According to an alternative exemplary embodiment, the skirt may not extend entirely around the waist of the wearer, but instead may leave a portion of the circumference uncovered.

The upper portion 110 of the swimwear apparatus may include an upper base layer 111 and an upper bikini layer 112. The upper base layer 111 may fit around the upper torso of the wearer and connect using a variety of mechanisms, such as snaps, zippers, or by tying two ends around the neck of the wearer. The upper bikini layer 112 may include one or more connecting portions 113 that are configured to attach the upper bikini layer 112 to the upper base layer 111. The connecting portions 113 may include snaps, waterproof hook and loop fasteners, buttons, waterproof zippers, or other mechanisms for attaching the upper bikini layer 112 to the upper base layer 111. The upper bikini layer 112 may be configured to be removable and interchangeable, such that the wearer can wear different upper bikini layers 112 with the upper base layer 111. Alternatively, the upper bikini layer may be permanently attached to the upper base layer 111.

According to an exemplary embodiment, the upper and lower base layers 101, 111 may have the receiving snap structure attached thereto while the upper and lower bikini layers 102, 112 may have the joining snap pieces attached. When the upper base layer 111 is attached to the upper bikini layer 112, a complete bikini top is formed. When the lower base layer 101 is snapped to the lower bikini layer 102, a complete bikini bottom is formed. The respective base layers 101, 111 and bikini layers 102, 112 come together to provide a secure and tight fit of the bikini layers. According to an exemplary embodiment, the lower base layer 101 may be semi-transparent so the wearer would need to wear the lower bikini layer 102 in order to cover the wearer's sensitive areas.

According to one or more exemplary embodiments, the lower base layer 101 may be made with a compression fabric. The compression fabric may be a power net mesh that is quick-drying, strong, and abrasion resistant. The power net mesh may be made from micro-denier nylon that pulls moisture away from the body and transports it to the surface of the garment, where it evaporates and leaves the skin cool and dry. This fabric provides greater support and a comfortable fit for the wearer, as well as reduces and or eliminates discomfort of inner thigh chaffing by providing a buffer of fabric. In addition, the lower base layer 101 may be made with a tan-through fabric that allows ultra-violet light to pass through the fabric, allowing the wearer's skin to tan under the base layer to minimize undesirable tan lines. The lower bikini layer 102 may include an inserted power mesh compression fabric sewn underneath or on top of the fabric of the lower bikini layer 102 to provide additional firm compression support when the lower bikini layer 102 is attached to lower base layer 101. The lower base layer 101 may also include a pad disposed at an upper thigh area so as to further prevent abrasion between the wearer's thighs. The pad may be integrally sewn into the lower base layer 101, but may alternatively be attached to the lower base layer 101 using other mechanisms, such as adhesives, zippers, snaps, buttons, etc.

The lower base layer 101 allows the wearer to camouflage imperfections in the skin, for example, surgical scars, pregnancy scars and skin disorders. The lower base layer 101 allows wearer the comfort of not having to worry about body parts popping out when walking, swimming, playing volleyball, fishing, kayaking or canoeing, as well as playing with family and friends.

According to one or more exemplary embodiments, the lower base layer 101 may include an opening (not shown) in the crotch region, which allows the wearer to use the restroom without having to remove the lower base layer 101. When the wearer needs to use the restroom, the wearer can detach the lower bikini layer 102, by for example, unsnapping it from the lower base layer 101, after which the wearer can use the restroom without having to remove the lower base layer 101, which may be cumbersome especially if it is wet from participating in water activities.

The upper base layer 111 and the upper bikini layer 112 form a bikini top when connected by the connecting portions 113. The interchangeable upper bikini layer 112 may be made with compression fabric to provide additional support to the breast area. In addition, the upper base layer 111 may be made with a tan-through fabric that allows ultra-violet rays to pass through the fabric, allowing the wearer's skin to tan under the base layer to minimize undesirable tan lines. According to one or more exemplary embodiments, fabric of the upper bikini layer 112 may be attached to the upper base layer 111 at three connection portions 113 for each breast, although a different number of connection portions may be used. The upper base layer 111 may have the receiving snap structure while the upper bikini layer 112 may have the corresponding snap pieces. The two snap pieces may come together to provide a secure and tight fit of the upper bikini layer 112 and the upper base layer 111 for the complete bikini top.

According to another exemplary embodiment, the swimwear apparatus may include a single base layer that is similar to a conventional one-piece bathing suit. According to this exemplary embodiment, the base layer may be made with a compression fabric. The compression fabric may be a power net mesh that is quick-drying, strong, and abrasion resistant. The power net mesh may be made from micro-denier nylon that pulls moisture away from the body and transports it to the surface of the garment, where it evaporates and leaves the skin cool and dry. The base layer of the exemplary embodiment may be semi-transparent so the wearer would need to wear a bikini layer in order to cover the wearer's sensitive areas. As in the previous exemplary embodiment, the base layer of this exemplary embodiment, may include an opening in the crotch region, which allows the wearer to use the restroom without having to remove the base layer.

According to this exemplary embodiment, the swimwear apparatus may also include one or more bikini layers that are configured to be attached to the single base layer. According to the exemplary embodiment, the swimwear apparatus may include upper and lower bikini layers having connecting portions as described above that are configured to attach to the single base layer.

Alternatively, the swimwear apparatus of the exemplary embodiment may include a single bikini layer that is configured to attach to the single base layer. The single bikini layer may include front and back bikini portions that are connected at the crotch region. The single bikini layer may have one or more connecting portions configured to attach the bikini layer to the base layer. The connecting portions may connect to the bikini layer to the base layer in a manner in which the front and back bikini portions do not connect on the side of the wearer. Alternatively, the front and back portions may connect on the side of the wearer.

FIGS. 5-8 illustrate a swimwear apparatus according to another exemplary embodiment. Referring to FIGS. 5-8, the swimwear apparatus according to this exemplary embodiment is similar to the exemplary embodiment of FIGS. 1-4, as it includes a lower base layer 101, lower bikini layer 102, and connecting portions 105. However, the connecting portions 105 of the exemplary embodiment of FIGS. 5-8 may have varying lengths and widths. For example, the top connecting portion 105 on one side of the front bikini portion 103 may extend further on the side of the wearer than the lower connecting portion 105 on the same side of the front bikini portion 103. In addition, the top connecting portion 105 on one side of the front bikini portion 103 may have a greater width than the lower connecting portion 105 on the same side of the front bikini portion 103.

Figure 10:
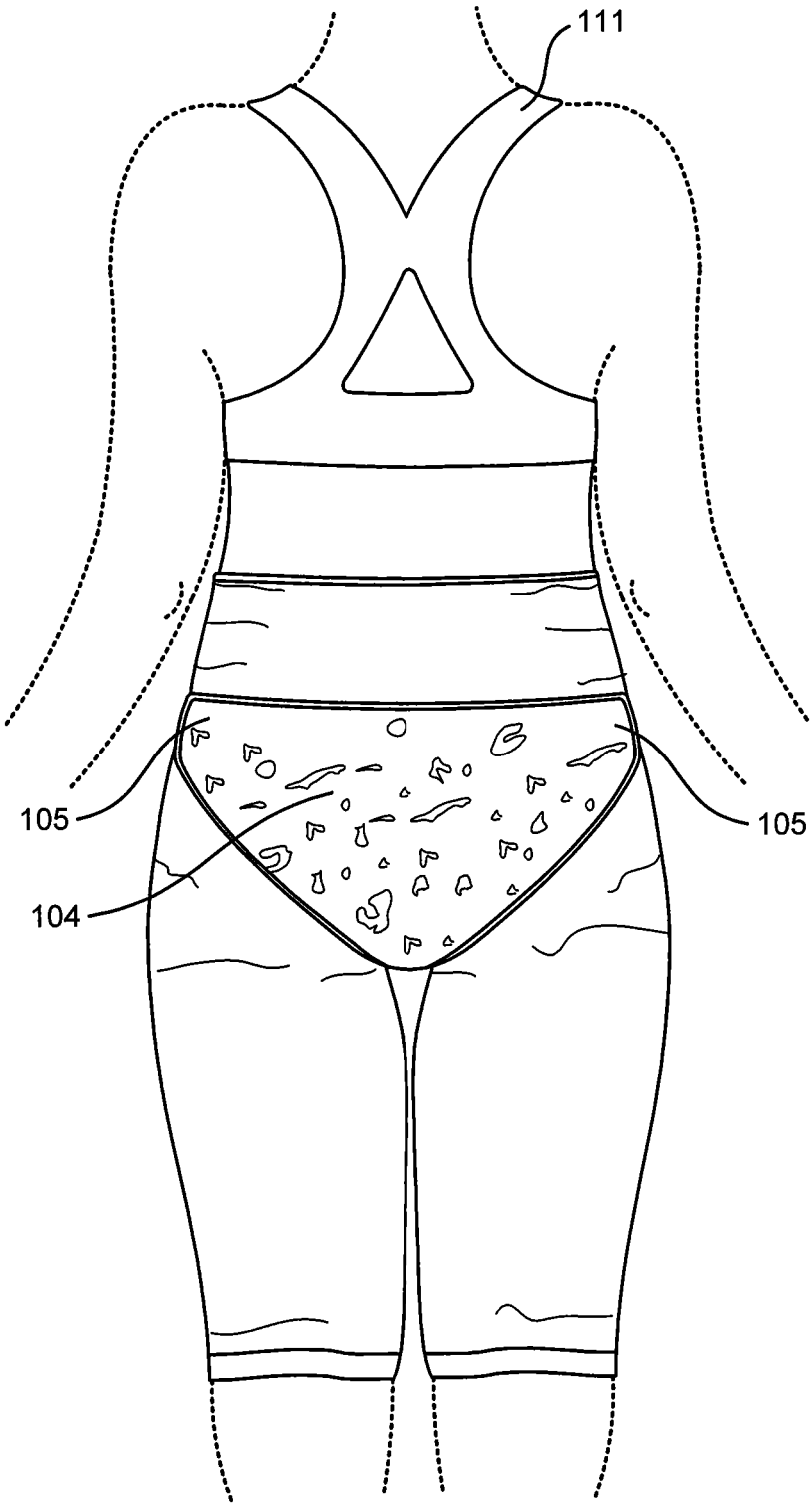
FIG. 10 is a rear view of a swimwear apparatus according to yet another exemplary embodiment
Figure 11:
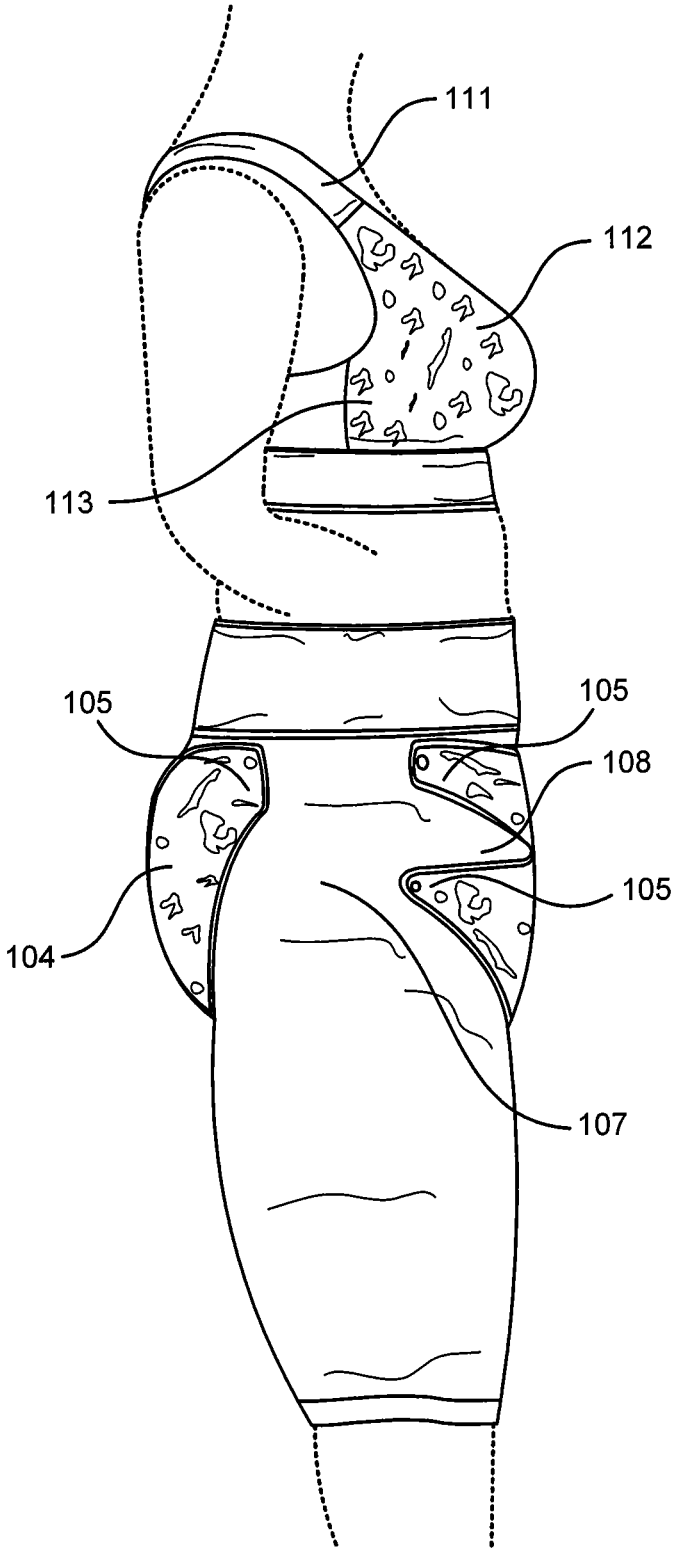
FIG. 11 is a right lateral view of a swimwear apparatus according to yet another exemplary embodiment.
Figure 12:
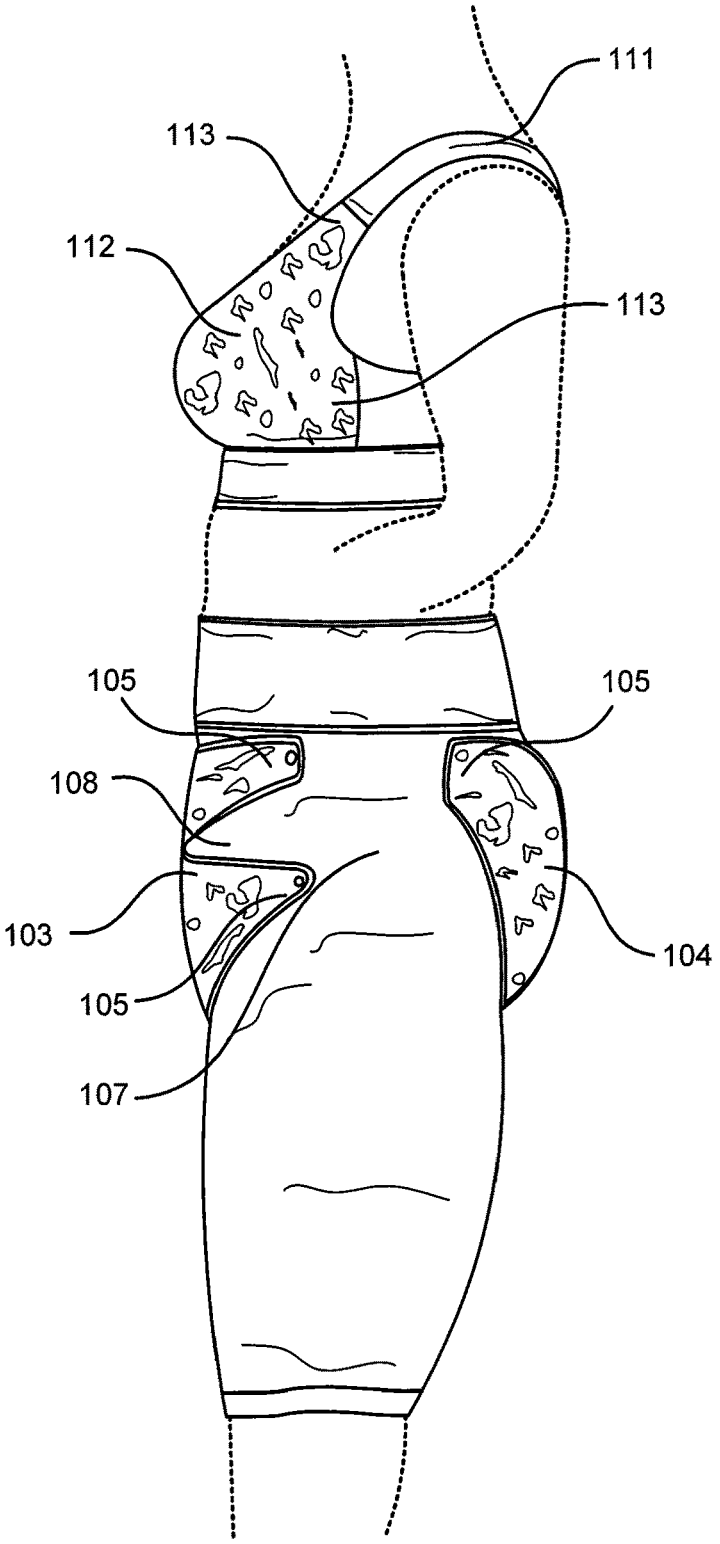
FIG. 12 is a left lateral view of a swimwear apparatus according to yet another exemplary embodiment.

FIGS. 9-12 illustrate a swimwear apparatus according to yet another exemplary embodiment. Referring to FIGS. 9-12, the swimwear apparatus according to this exemplary embodiment is similar to the exemplary embodiment of FIGS. 1-4, as it includes a lower base layer 101, lower bikini layer 102, and connecting portions 105. However, the connecting portions 105 of the exemplary embodiment of FIGS. 5-8 may be configured so that the gap 108 between the top connecting portion and bottom connecting portion 105 on one side of the front bikini portion 103 is substantially triangular in shape. In other words, the width of the gap 108 between the top connecting portion and bottom connecting portion 105 on one side of the front lower bikini portion 103 is larger near the side of the wearer and narrower near the center of the front lower bikini portion 103. In addition, as shown in FIG. 10, the back lower bikini portion may only include two connection portions 105, such that there is no gap 108 between connection portions of the back lower bikini portion 104. Configuring the connection portions 105 in the manner shown in this exemplary embodiment, may provide increased flexibility in affixing the lower bikini layer 102 to the lower base layer 101.

Figure 13:
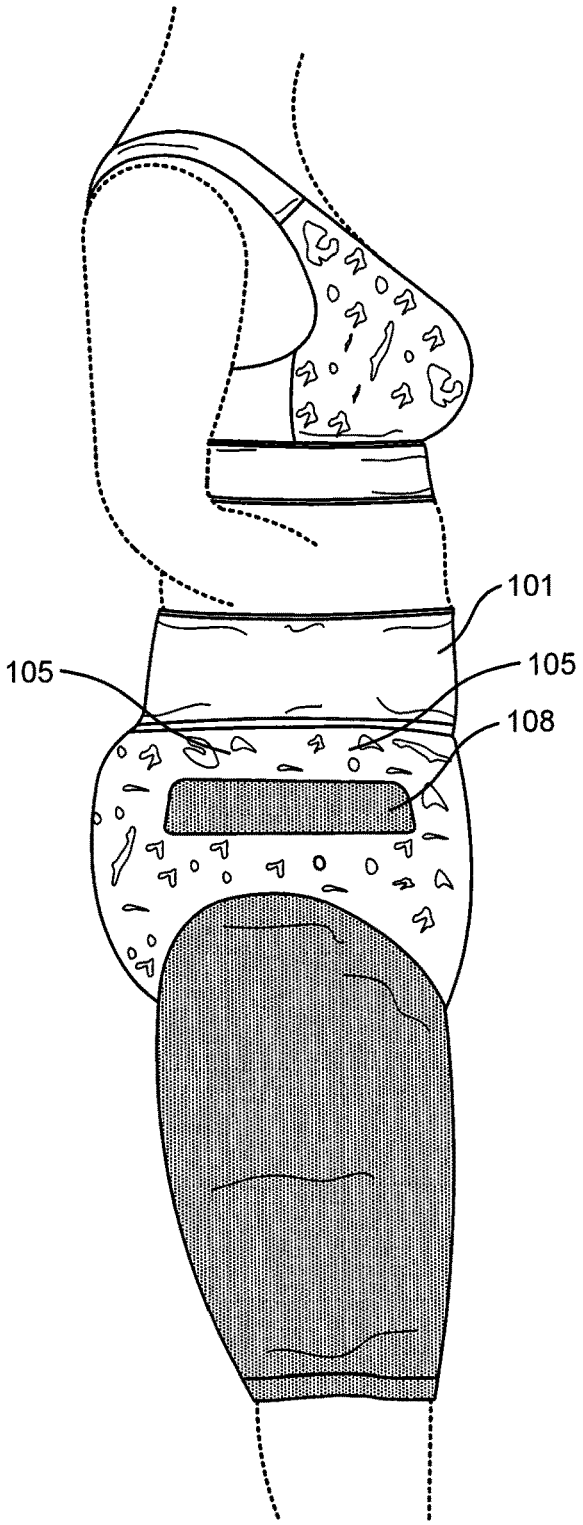
FIG. 13 is a right lateral view of a swimwear apparatus according to yet another exemplary embodiment.

FIG. 13 illustrates a swimwear apparatus according to yet another exemplary embodiment. Referring to FIG. 13, the swimwear apparatus according to this exemplary embodiment is similar to the exemplary embodiment of FIGS. 1-4, as it includes lower base layer 101, lower bikini layer 102, and connecting portions 105. However, the connecting portions 105 of the front lower bikini portion 103 and the back lower bikini portion 104 may be attached, removably or permanently, on the side of the wearer, such that there is no vertical gap 107 between the front and back lower bikini portions 103, 104. According to this exemplary embodiment, there may still be a horizontal gap 108 between the connection portions 105 on each side of the front and back lower bikini portions 103, 104. The connection portions 105 of the front lower bikini portion 103 may be attached to the connection portions 105 of the back lower bikini portion 104 using stitching, snaps, buttons, waterproof zippers, hook and loop connectors, ties, etc.

Figure 14:
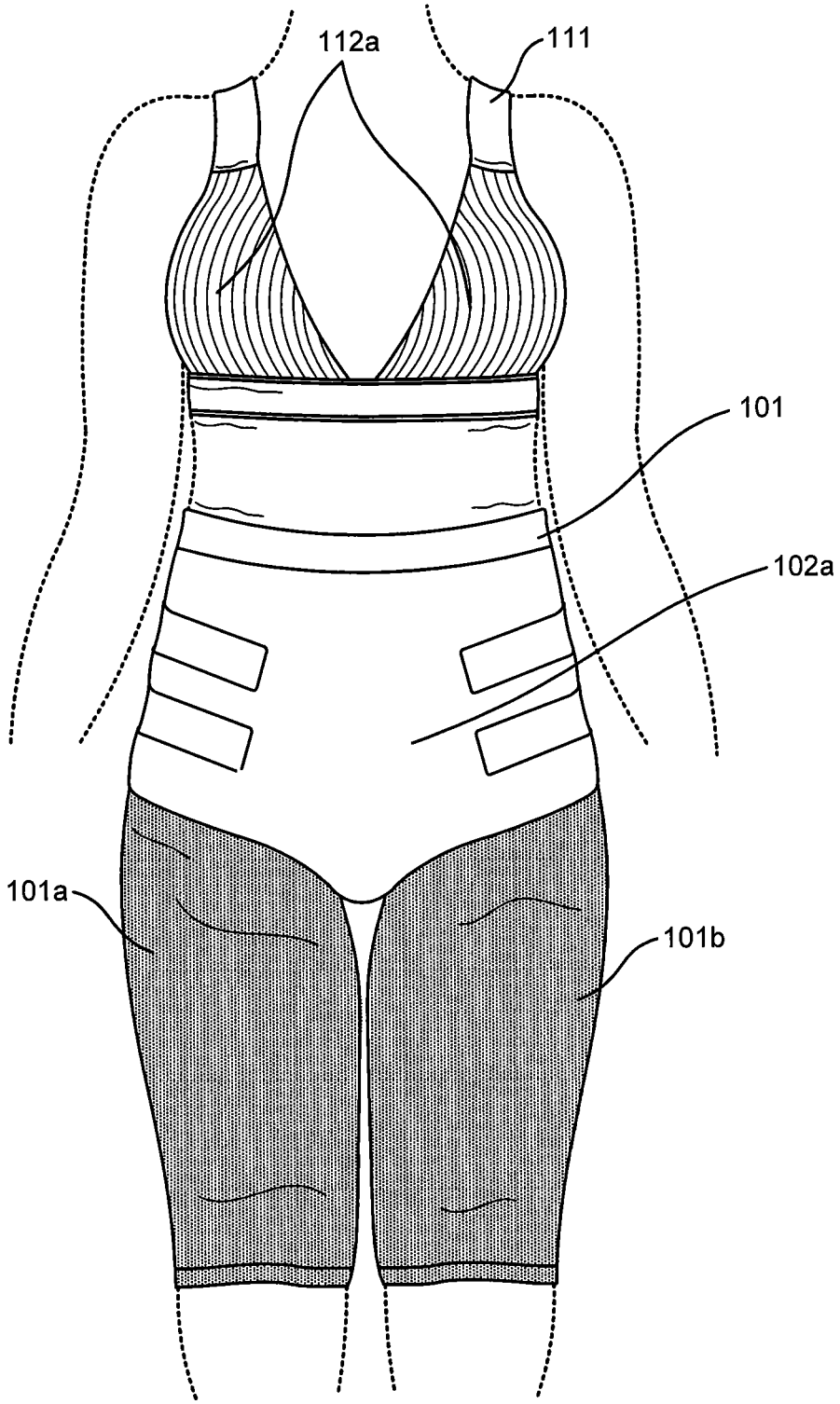
FIG. 14 is a front view of a swimwear apparatus according to yet another exemplary embodiment

The lower bikini layer 102 may also be attached, removably or permanently, to the lower base layer 101. According to an exemplary embodiment, as shown in FIG. 14, the lower base layer 101 may include two lower base leggings 101*a* and 101*b*, which may be removably or permanently attached to the bottom of the lower bikini layer 102. For example, the lower base leggings 101*a* and 101*b* may be attached to the bottom of the lower bikini layer 102 via stitching, buttons, snaps, waterproof zippers, hook and loop connectors, clips, ties, etc. In addition, the lower base leggings 101*a* and 101*b* may be detached from the lower bikini layer 102 separately. That is, the wearer can choose to attach one, both, or neither of the lower base leggings 101*a*, 101*b* to the lower bikini layer 102. Alternatively, the lower base leggings 101*a* and 101*b* may be attached, removably or permanently, to the bottom of the lower base layer 101, as opposed to the lower bikini layer 102. For example, if the lower base layer 101 is shorts-length, the lower base leggings 101*a* and 101*b* may attach to the bottom of the base layer 101 to extend coverage to the wearer's knees (not shown).

According to an exemplary embodiment, the lower base layer 101 may not include a portion that covers the groin area of the wearer, which is instead covered by the lower bikini layer 102. According to an exemplary embodiment, the lower base layer 101 may serve as a liner for the lower bikini layer 102, including or not including the groin region of the wearer. According to an exemplary embodiment in which the lower bikini layer 102 includes a horizontal gap on one or more sides of the wearer, the lower base layer 101 may or may not be visible within the horizontal gap. If the lower base layer 101 is not visible in the horizontal gap, the wearer's skin may be visible in the horizontal gap. According to an exemplary embodiment, the lower base layer 101 may extend above the top of the lower bikini layer 102 so as to provide support for the stomach area of the wearer. The portion of the lower base layer 101 that extends above the top of the lower bikini layer 102 may be made of the same or different material as the lower base layer 101 that is underneath the lower bikini layer 102 and/or the lower base leggings 101*a*, 101*b*. The lower base leggings 101*a*, 101*b* may be made of a compression fabric, an ultraviolet resistant fabric, or a tan-through fabric, though other types of fabrics may also be used. In addition, the lower base leggings 101*a*, 101*b* may have various lengths, including shorts, capri length, and ankle-length.

Figure 15:
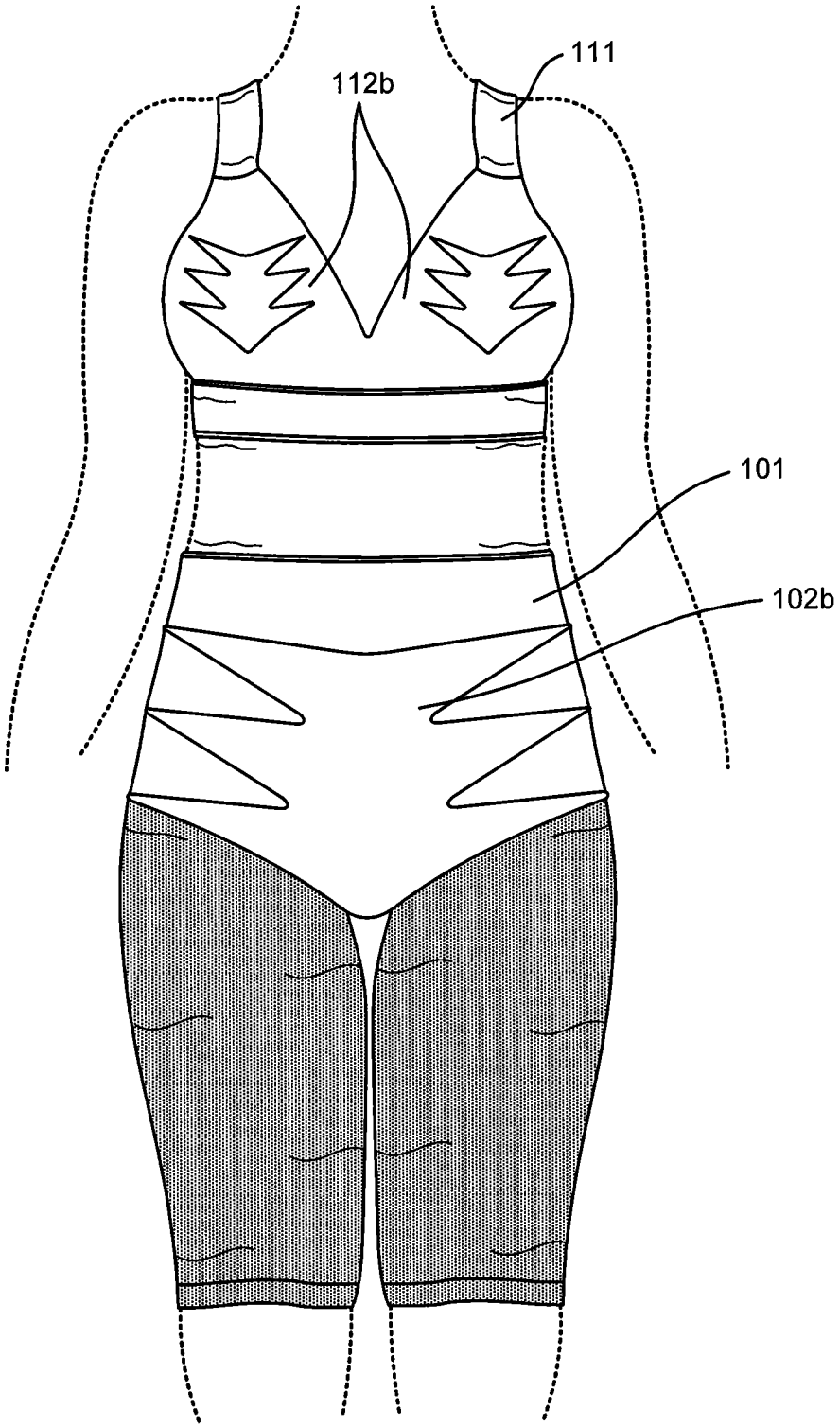
FIG. 15 is a front view of a swimwear apparatus according to yet another exemplary embodiment.

According to yet another exemplary embodiment, as shown in FIGS. 14 and 15, there may be provided first and second upper bikini layers 112*a*, 112*b*, which may be configured to be attached to the upper base layer 111. First upper bikini layer 112*a* may be attached to a first side of the upper base layer 111, and second upper bikini layer 112*b* may be attached to a second side of the upper base layer 111. Likewise, there may be provided first and second lower bikini layers 102*a*, 102*b*, which may be configured to be attached to the lower base layer 101. The first lower bikini layer 102*a* may be attached to a first side of the lower base layer 101, and the second lower bikini layer 102*b* may be attached to a second side of the lower base layer. One or more of the first upper bikini layer 112*a*, the second upper bikini layer 112*b*, the first lower bikini layer 102*a*, and the second lower bikini layer 102*b* may be removably or permanently attached to the respective upper base layer 111 and lower base layer 101. By providing bikini layers on both sides of the base layers, the wearer can decide which bikini layers will be outward facing and which bikini layers will be inward facing, so as to provide multiple wearing options.

Although the inventive concepts of the present disclosure have been described and illustrated with respect to exemplary embodiments thereof, it is not limited to the exemplary embodiments disclosed herein and modifications may be made therein without departing from the scope of the inventive concepts.

What is claimed is:

1. A swimwear apparatus comprising:

an upper portion having an upper base layer and an upper bikini layer configured to be attached to the upper base layer; and a lower portion having a lower base layer and a lower bikini layer having two leg holes, the lower bikini layer being configured to be attached to the lower base layer;

wherein the lower base layer extends beyond at least one of the two leg holes of the lower bikini layer; and wherein the lower base layer comprises a pad disposed at an upper thigh area below at least one leg hole of the lower bikini layer.

2. The swimwear apparatus of claim 1, wherein the lower base layer comprises one or more legging portions that are configured to be removably attached to the portion of the lower base layer that extends beyond at least one of the two leg holes of the lower bikini layer.

3. The swimwear apparatus of claim 2, wherein each of the one or more legging portions comprises a first side and a second side; and wherein each of the one or more leggings is configured to be reversibly attached to the lower base layer so that either the first side or the second side is outwardly facing.

4. The swimwear apparatus of claim 1, wherein the lower bikini layer includes a front lower bikini portion and a back lower bikini portion;

wherein the front lower bikini portion and the back lower bikini portion are configured to be removably attached to the lower base layer; and wherein the front lower bikini portions is configured to be removably attached to the back lower bikini portion.

5. The swimwear apparatus of claim 4, wherein the front lower bikini portion comprises a first connection portion configured to be removably attached to a first side of the lower base layer, and a second connection portions configured to be removably attached to a second side of the lower base layer; and wherein the back lower bikini portion comprises a third connection portion configured to be removably attached to the first side of the lower base layer, and a fourth connection portion configured to be removably attached to the second side of the lower base layer.

6. The swimwear apparatus of claim 5, wherein the first connection portion and the third connection portion are configured to be removably attached to the first side of the lower base layer so that the lower base layer is exposed in a gap between the first and third connection portions.

7. The swimwear apparatus of claim 5, wherein the front lower bikini portion further comprises a fifth connection portion configured to be removably attached to the first side of the lower base layer, and a sixth connection portion configured to be removably attached to the second side of the lower base layer; and wherein the back lower bikini portion further comprises a seventh connection portion configured to be removably attached to the first side of the lower base layer, and an eighth connection portion configured to be removably attached to the second side of the lower base layer.

8. The swimwear apparatus of claim 7, wherein the first and third connection portions are configured to be removably attached to the first side of the lower base layer so that the lower base layer is not exposed between the first and third connection portions;

wherein the fifth and seventh connection portions are configured to be removably attached to the first side of the lower base layer so that the lower base layer is not exposed between the fifth and seventh connection portions; and wherein the lower base layer is exposed in a gap disposed below the first and third connection and above the fifth and seventh connection portions.

9. A swimwear apparatus comprising:

an upper portion having an upper base layer and an upper bikini layer configured to be attached to the upper base layer; and a lower portion having a lower base layer, a first lower bikini layer configured to be attached to an inner side of the lower base layer, and a second lower bikini layer configured to be attached to an outer side of the lower base layer.

10. The swimwear apparatus of claim 9, wherein the upper bikini layer comprises a first upper bikini layer configured to be attached to an inner side of the upper base layer, and a second upper bikini layer configured to be attached to an outer side of the upper base layer.

11. The swimwear apparatus of claim 10, wherein the at least one of the first lower bikini layer, the second lower bikini layer, the first upper bikini layer, and the second upper bikini layer are configured to be removably attached to their respective lower base layer and upper base layer.

12. The swimwear apparatus of claim 9, wherein the first lower bikini layer and the second lower bikini layer have two leg holes; and wherein the lower base layer comprises an abrasion resistant portion disposed at an upper thigh area below each leg hole of the two leg holes.

13. The swimwear apparatus of claim 9, wherein the lower portion is configured to be worn so that either of the first lower bikini layer and the second lower bikini layer are outwardly facing.

14. The swimwear apparatus of claim 9, wherein the lower base layer comprises one or more legging portions that are configured to be attached to one or both of the first lower bikini layer and the second lower bikini layer.

15. A swimwear apparatus comprising:

an upper portion having an upper base layer and an upper bikini layer configured to be attached to the upper base layer; and a lower portion having a lower base layer, a first lower bikini layer configured to be attached to an inner side of the lower base layer, and a second lower bikini layer configured to be attached to an outer side of the lower base layer;

wherein the lower base layer comprises one or more legging portions that are configured to be removably attached to the lower base layer.

16. The swimwear apparatus of claim 15, wherein each of the one or more legging portions comprises a first side and a second side; and wherein each of the one or more leggings is configured to be reversibly attached to the lower base layer so that either the first side or the second side is outwardly facing.

17. The swimwear apparatus of claim 15, wherein the lower bikini layer includes a front lower bikini portion and a back lower bikini portion;

wherein the front lower bikini portion and the back lower bikini portion are configured to be removably attached to the lower base layer; and wherein the front lower bikini portions is configured to be removably attached to the back lower bikini portion.

18. The swimwear apparatus of claim 17, wherein the front lower bikini portion comprises a first connection portion configured to be removably attached to a first side of the lower base layer, and a second connection portions configured to be removably attached to a second side of the lower base layer; and wherein the back lower bikini portion comprises a third connection portion configured to be removably attached to the first side of the lower base layer, and a fourth connection portion configured to be removably attached to the second side of the lower base layer.

19. The swimwear apparatus of claim 18, wherein the first connection portion and the third connection portion are configured to be removably attached to the first side of the lower base layer so that the lower base layer is exposed in a gap between the first and third connection portions.

20. The swimwear apparatus of claim 15, wherein the upper bikini layer comprises a first upper bikini layer configured to be attached to an inner side of the upper base layer, and a second upper bikini layer configured to be attached to an outer side of the upper base layer.

* * * * *